United States Patent [19]

Yudis et al.

[11] Patent Number: 4,510,649

[45] Date of Patent: Apr. 16, 1985

[54] TIE STRIP

[76] Inventors: Donald W. Yudis, 322 Grimes Bridge Rd., Roswell, Ga. 30075; Roy A. Moody, 755 Ash St., Flossmoor, Ill. 60439

[21] Appl. No.: 500,660

[22] Filed: Jun. 3, 1983

[51] Int. Cl.[3] ..... B65D 63/00

[52] U.S. Cl. ..... 24/16 PB; 24/30.5 P

[58] Field of Search ..... 24/16 R, 16 PB, 17 R, 24/17 A, 17 AP, 20 R, 20 EE, 30.5 R, 30.5 P, 23 EE, 150 FP, 30.5 S; 292/307 A, 322; 248/74.5

[56] References Cited

U.S. PATENT DOCUMENTS

| | | | |
|---|---|---|---|
| 1,912,180 | 5/1933 | Cornell | 24/20 EE |
| 2,341,608 | 2/1944 | Gey | 24/16 PB |
| 2,936,980 | 5/1960 | Rapata . | |
| 2,961,785 | 11/1960 | Toepfer . | |
| 3,156,922 | 11/1964 | Anderson | 24/16 PB X |
| 3,362,411 | 1/1968 | Moller . | |
| 3,438,095 | 4/1969 | Evans . | |
| 3,913,178 | 10/1975 | Ballin | 24/16 PB |
| 3,973,610 | 8/1976 | Ballin | 24/16 PB X |
| 4,077,562 | 3/1978 | Ballin . | |
| 4,150,463 | 4/1979 | Brown | 24/16 PB |
| 4,223,424 | 9/1980 | Burnett . | |
| 4,333,210 | 7/1982 | Burnett . | |
| 4,367,571 | 1/1983 | Speirs et al. | 24/20 EE X |

FOREIGN PATENT DOCUMENTS

| | | | |
|---|---|---|---|
| 1005269 | 9/1965 | United Kingdom . | |
| 1032303 | 6/1966 | United Kingdom | 24/20 EE |

*Primary Examiner*—Victor N. Sakran
*Assistant Examiner*—James R. Brittain

[57] ABSTRACT

An integral tie strip formed from sheet stock for fastening elongate objects or for closure of containers. The tie including a substantially planar elongated strap having a plurality of raised portions formed on and projecting from the plane of the strap. Joined to the strap is a substantially planar head having a slit which accepts the strap and flexibly accommodates the receipt of the strap and the raised portions upon insertion of the strap into the head but engages the raised portions upon retrograde movement of the strap. Formed on the head is a locking tongue which is positioned to engage the raised portions and ensure that the raised portions cannot pass through the slit upon retrograde movement of the strap.

16 Claims, 4 Drawing Figures

TIE STRIP

BACKGROUND OF THE INVENTION

The present invention generally relates to a fastener for bundling discrete elongate objects or for a closure fastener for bags or other containers. More specifically, the present invention relates to a one piece tie strip formed from sheet stock having a substantially planar elongate strap with a locking head joined at one end, the head receiving the distal end of the strap and selectively locking the strap along its length to form a cylindrical fastener of desired circumference for bundling elongated objects or sealing containers.

The use of tie strips as fasteners to bundle wires, tubing, and other elongated objects, or to seal bags or other containers, is known. The desirable characteristics of a tie strip include adjustability to accommodate varying bundle sizes, positive locking action to ensure that the fastener will not slip, a substantially cylindrical inner surface, being free of any substantial discontinuities, to effect a symmetrical bundle and ensure a positive locking action, a thin profile to decrease interference problems between the bundled objects and their environment, non-serrated or substantially smooth side edges to ensure non-interference between the tie strip and the object fastened and to reduce stress concentrations in the tie strip, and in certain applications it is desirable for the outer surface of the tie to be substantially planar and of sufficient surface area to display informative patterns or alphanumerics that can be easily read at a distance. Additional desirable characteristics are simplicity of design, ease of manufacture, one-piece construction, and low manufacturing cost.

Known tie strips include many different structural configurations. In general, one type of tie strip presents serrated edges that interlock with an opening in the head of the tie strip or with a plurality of openings positioned along the length of the tie strip. Another type of tie strip presents non-serrated edges with a plurality of openings located along the length of the tie strip; the openings being shaped to deform or fold the tie strip upon insertion, usually along the medial longitudinal axis of the tie strip, thus deforming the inner surface of the tie strip. Many of the known tie strips are designed to be easily removable, but can also easily become inadvertently loosened. Although different known tie strips possess some of the characteristics desirable in a tie strip, they also possess many undesirable characteristics, leaving room for improvement in the tie strip art.

SUMMARY OF THE INVENTION

It is therefore an object of the present invention to provide a tie strip that is selectively adjustable to accommodate varying sizes of bundles or containers.

It is another object of the present invention to provide a tie strip that positively and reliably locks to retain the size selected.

It is an additional object of the present invention to provide a tie strip that audibly signals when the tie strip has been locked.

It is a further object of the present invention to provide a tie strip that presents a substantially cylindrical inner surface that is free of substantial discontinuities.

It is another object of the present invention to provide a tie strip having a thin profile.

It is a further object of the present invention to provide a tie strip that presents non-serrated edges to ensure non-interference between the tie strip and the object fastened and in order to reduce stress concentrations for the tie strip.

It is an additional object of the present invention to provide a tie strip that presents sufficient surface area around its circumference to display marking information.

It is another object of the present invention to provide a tie strip that has a one-piece construction and is economical and simple to manufacture. These and other objects, together with the advantages thereof over existing prior art forms, which will become apparent from the following specification, are accomplished by means hereinafter described.

In general, the tie strip of the present invention includes a substantially planar elongated flexible strap, having a plurality of raised portions formed on and projecting from the plane of the strap, the raised portions being spaced along the length of the strap; and a substantially planar head formed at one end of the strap, having a head slit extending through the head of a width to accommodate receipt of the strap without substantial deformation of the planar strip. The head being flexible to permit expansion of the head slit to accommodate the raised portions, whereby movement of the strap toward the head and through the head slit causes the raised portion to expand and the head slit and pass therethrough, retrograde movement of the strap causing the head to engage the raised portion preventing withdrawal of the strap from the head. Provided on the tie strip is a means to prevent inadvertent disengagement of one of the raised portions from the head.

DESCRIPTION OF THE PREFERRED EMBODIMENT

Figure 1:
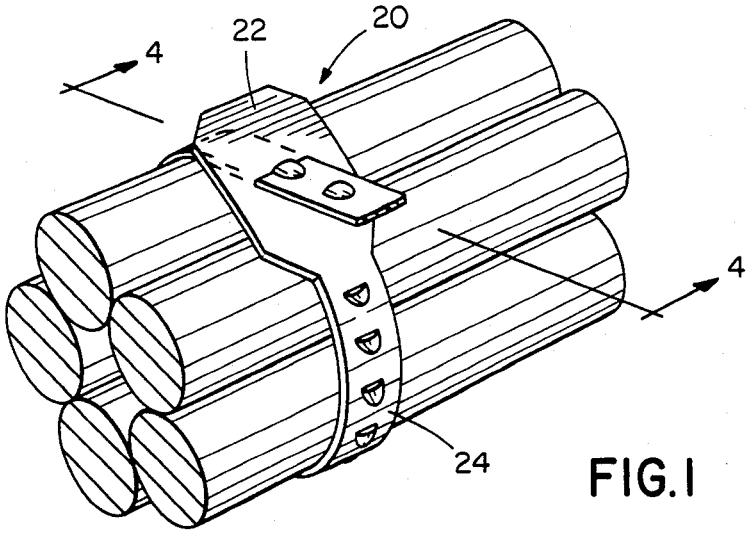
FIG. 1 is a perspective view of a tie strip embodying the concept of the present invention, as seen fastening a bundle of cylindrical elongated members.

A one-piece thermoplastic tie strip embodying the concept of the present invention is designated generally by the number 20 in the accompanying drawings. The tie strip 20 includes a head 22 integrally formed with a strap 24.

The head 22 is planar being about twice the width of strap 24 having tapered edges 26 leading to lateral edges 28 of strap 24. Medially positioned on and extending through the plane of head 22 is head slit 30. Head slit 30 is a linear slit positioned perpendicular to a medial longitudinal line of the head 22 and strap 24 having two medial slanting portions 32 that together form a tongue 34 in the head 22. The head slit 30 is of a width sufficient to accommodate receipt of the strap 24 without substantially deforming the planar strap 24, thus effecting a substantially cylindrical inner surface free of substantial discontinuities in tie strip 20. The head 22 is flexible to permit expansion of head slit 30 to accommodate strap 24.

The tongue 34 is symmetrically positioned with respect to the medial longitudinal line of the strap 24 and head 22, and projects towards the strap 24. The tongue 34 is a small V-shaped flap, formed in head 22 by head slit 30, that effects the locking of strap 24 in head slit 30.

Extending from head slit 30 towards strap 24 is lead-in surface 36 which facilitates the insertion of the distal end of strap 24 into head slit 30. The lead-in surface 36 is an indented portion of head 22 being formed by a pair of discontinuous surfaces 37 which are out of the plane of the head 22. The discontinuous surfaces 37 together form a lead-in surface 36 that has a triangular shape with legs of the triangle extending from the outer ends of head slit 30 to a point on the head 22 between head slit 30 and strap 24. The indentation of the lead-in surface 36 forms a gap 38 between tongue 34 formed on the outer edge of head slit 30, and the inner edge of head slit 30 adjacent lead-in surface 36. This gap 38 facilitates insertion of the distal end of strap 24 into head slit 30. The practical necessity of the lead-in surface 36 depends on the dimensions and type of material from which the tie strip 20 is manufactured. For example, tie straps 20 of larger dimensions and/or rigidity may dispense with the lead-in surface 36 as an unnecessary feature.

The strap 24 is an elongate member having a substantially planar surface, the width of strap 24 being many times the thickness of strap 24. The length of strap 24 is sized to encircle the bundle or container with which the tie strip 20 is to be used. The end of strap 24 opposite head 22 has a pointed tip 40 which facilitates the insertion of strap 24 into head slit 30. The lateral edges 28 of strap 24 are smooth and non-serrated extending from tapered edges 26 of head 22 to the tapered edges of tip 40.

Positioned along the length of strap 24 are raised portions 42 that project substantially perpendicularly from the plane of strap 24 in a direction opposite the projection of lead-in surface 36. In preferred form, spaces separating adjacent raised portions 42 are equal, in order to allow equal incremental adjustment of the circumference of the tie strip 20, although the raised portions 42 could be separated by varying distances. The raised portions 42 are each formed adjacent respective strap slits 44 which project through strap 24, the edge of strap slits 44 being spaced apart transverse to the plane of strap 24 to form a mouth 46 the upper boundary of which is the raised portion 42. The mouth 46 is directed towards tongue 34 when the tie strip 20 is planar. The raised portions 42 have a width which varies from its widest point adjacent the strap slit 44, tapering to a rounded end. The raised portions 42 project above the surface of strap 24 an amount necessary to allow easy insertion of tongue 34 while still insuring retention of tongue 34. In height, the raised portions 42 taper from a high point adjacent the strap slits 44 to the surface of the strap 24.

Figure 4:
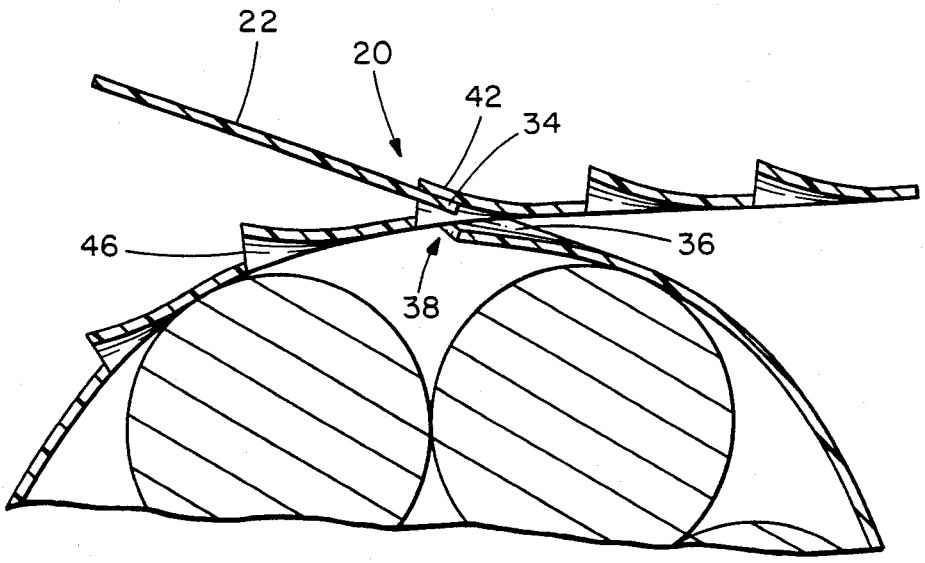
FIG. 4 is a sectional view of a portion of the tie strip of FIG. 1, showing the tie strip circumscribing the cylindrical elongated members.

As best seen in FIGS. 1 and 4, the fastening of a number of elongated objects by the tie strip 20 is effected by encircling the objects with strap 24 so that the raised portions are located on the outer surface of the curved strap 24, inserting the pointed tip 40 into the gap 38, and drawing successive raised portions 42 through gap 38 until the desired circumference of the tie strip 20 is attained. The combination of the flexible head 22, the wedge like tapered shape of the raised portions 42, and the indented lead-in surface 36 allows raised portions 42 to easily pass through the head slit 30. Retrograde movement or withdrawal of strap 24 is resisted by raised portion 42 abutting and containing tongue 34 which resists further withdrawal of strap 24 from head slit 30. The raised portion 42 thus is restrained by tongue 34 from deflecting beneath the plane of the head 22, ensuring that continued retrograde force applied to strap 24 will hold raised portion 42 against the adjacent tongue 34, preventing inadvertent removal of strap 24 from head 22, and maintaining the adjacent raised portion 42 in engagement with head 22. Additionally, the envelopment of tongue 34 by raised portion 42 protects tongue 34 from abrasion which otherwise could destroy the ability of tongue 34 to prevent withdrawal of strap 24.

In certain environments in which the tie strip 20 may be used, the confined position of the elongated objects to be circumscribed by the tie strip 20 may make it difficult to visually confirm whether the tie strip 20 has been successfully locked at the desired circumference. The tie strip 20 solves this problem by issuing an audible click as tongue 34 flexes over raised portion 42 and is positioned to enter mouth 46 to lock the tie strip 20. This audible click informs the user of the tie strip 20 that the tie strip 20 is positioned to be locked at its present circumference. The audible click is valuable even when visual conformation of the locking of the tie strip 20 is possible, in that a user is able to reliably tighten the tie strip 20 while concurrently using his visual sense for other tasks.

Figure 2:
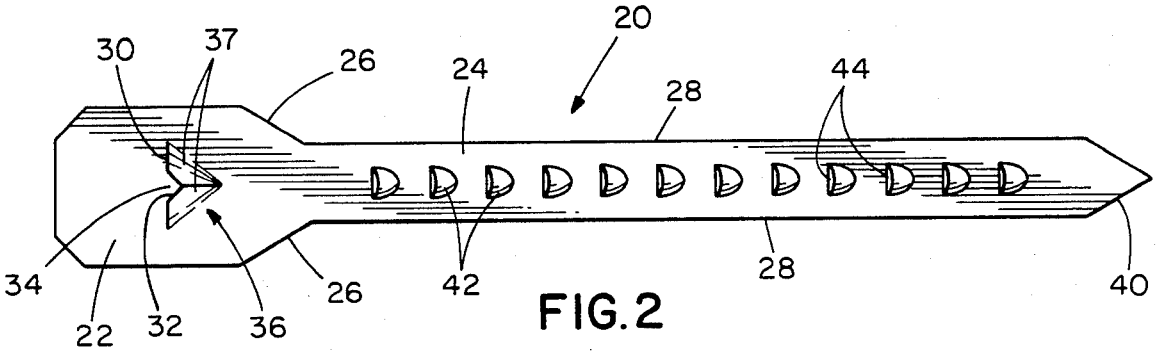
FIG. 2 is a plan view of the tie strip of FIG. 1.
Figure 3:
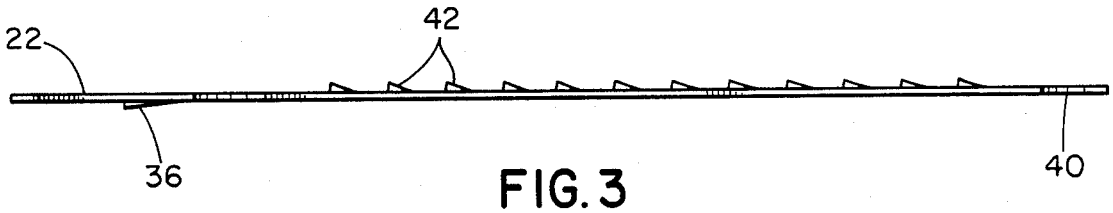
FIG. 3 is a side view of the tie strip of FIG. 1.

The above described structural configuration of the tie strip 20 facilitates the economical and simple manufacture of the strips. In preferred construction, the tie strip 20 is cut from vinyl or polyethylene sheet stock having a preferred thickness which can vary from approximately 0.010 to 0.030 inches. The sheet stock can be pre-printed with color codes or alphanumerics if desired. The raised portions 42, head slit 30, and lead-in surface 36 are embossed on sheet stock to form the tie strip 20 without removing any material from the tie strip 20. Thus resulting in a one piece tie strip 20 where, due to the deformation of its surface by embossing, the surface area of head 22 and strap 44 is greater than the surface area of a strip having the same dimensions but lying in a single plane. Additionally, the tie strip design of the present invention presents a surface area that is visually unbroken, head slit 30 and strap slits 44 being the only apertures on the surface of the tie strip 20 and these being practically invisible when viewed directly as in FIG. 2. Thus the relatively wide planar surface of strap 24 and head 22 in combination with the substantially whole visual surface of the tie strip 20 facilitates the effective use of the tie strip 20 as a visual information carrier.

What is claimed is:

1. An integral tie strip formed from sheet stock, comprising:

a substantially planar elongated flexible strap;

a plurality of raised portions formed on and projecting from the plane of said strap, said raised portions being spaced along the length of said strap with each of said raised portions being formed from a portion of said planar strap immediately adjacent a strap slit, said strap slit including first and second opposing edges which are spaced apart transverse to the plane of said strap to define a mouth in said strap;

a substantially planar head formed at one end of said strap, having a head slit extending through said head of a width to accommodate receipt of said strap such that a strap inserted therein retains its substantially planar configuration; and locking means affixed to said head for preventing inadvertent disengagement of one of said raised portions from said head upon retrograde movement of said strap, at least one of said head and said raised portions being flexible to permit movement of said raised portions through said head slit whereby movement of said strap toward said head and through said head slit causes said raised portions to pass therethrough and retrograde movement of said strap causes said head to engage one of said raised portions preventing withdrawal of said strap from said head, with said locking means ensuring that said raised portion is not inadvertently removed from said head slit.

2. The tie strip of claim 1 wherein:

said locking means comprises a tongue affixed to said head, said tongue entering said mouth upon retrograde movement of said strap, each of said raised portions containing said tongue to prevent inadvertent movement of said tongue relative to said strap thereby maintaining said raised portion in engagement with said head.

3. The tie strip of claim 2 wherein said raised portions are widest at the edge of said strap slits.

4. The tie strip of claim 2 wherein a lead-in surface on said head adjacent said head slit is formed out of the plane of said head in a direction opposite to the direction of said raised portions.

5. The tie strap of claim 4 wherein said lead-in surface of said head adjacent said head slit is disposed between said head slit and said strap.

6. The tie strip of claim 1 wherein the strip is formed from a solid sheet and the surface area of said tie strip before said raised portions are formed thereon is less than the surface area of said tie strip after said raised portions are formed thereon.

7. The tie strip of claim 6 wherein the structural features of said tie strip are formed without removing material from said strip.

8. The tie strip of claim 1 wherein said strap has a pair of lateral edges each of which is substantially smooth and continuous.

9. An integral tie strip, comprising:

a substantially planar elongated flexible strap;

a plurality of raised portions formed on and projecting from the plane of said strap, said raised portion being spaced along the length of said strap with each of said raised portions being formed from a portion of said planar strap immediately adjacent a strap slit, said strap slit including first and second opposing edges which are spaced apart transverse to the plane of said strap to define a mouth in said strap;

a substantially planar head formed at one end of said strap, having a head slit extending through said head of a width to accommodate receipt of said strap such that a strap inserted therein retains its substantially planar configuration; and a tongue affixed to said head and positioned to engage said raised portions in order to prevent inadvertent disengagement of one of said raised portions from said head upon retrograde movement of said strap, at least one of said head and said raised portions being flexible to permit movement of said raised portions through said head slit to accommodate said raised portions, whereby movement of said strap toward said head and through said head slit causes said raised portions to pass therethrough and retrograde movement of said strap causes said head to engage one of said raised portions preventing withdrawal of said strap from said head.

10. The tie strip of claim 9 wherein said tongue enters said mouth upon retrograde movement of said strap, said raised portion containing said tongue to prevent inadvertent movement of said tongue relative to said strap thereby maintaining said raised portion in engagement with said head.

11. The tie strip of claim 10 wherein said raised portions are widest at the edge of said strap slits.

12. The tie strip of claim 9 wherein the strip is formed from a solid sheet and the surface area of said tie strip before said raised portions are formed thereon is less than the surface area of said tie strip after said raised portions are formed thereon.

13. The tie strip of claim 12 wherein the structural features of said strip are formed without removing material from said strip.

14. The tie strip of claim 9 wherein a lead-in surface on said head adjacent said head slit is formed out of the plane of said head in a direction opposite to the direction of said raised portions.

15. The tie strap of claim 14 wherein said lead-in surface of said head adjacent said head slit is disposed between said head slit and said strap.

16. The tie strip of claim 9 wherein said strap has a pair of lateral edges each of which is substantially smooth and continuous.

* * * * *